US005566542A

United States Patent [19]

Chen et al.

[11] Patent Number: 5,566,542

[45] Date of Patent: Oct. 22, 1996

[54] METHOD FOR REGULATING AND AUGMENTING THE POWER OUTPUT OF A GAS TURBINE

[75] Inventors: Allen G. Chen, Orlando; Leslie R. Southall, Longwood, both of Fla.

[73] Assignee: Westinghouse Electric Corporation, Pittsburgh, Pa.

[21] Appl. No.: 295,114

[22] Filed: Aug. 24, 1994

[51] Int. Cl.[6] ..... F02C 3/30

[52] U.S. Cl. ..... 60/39.05; 60/39.3; 60/39.55

[58] Field of Search ..... 60/39.05, 39.3, 60/39.53, 39.54, 39.55

[56] References Cited

U.S. PATENT DOCUMENTS

| | | | |
|---|---|---|---|
| 3,693,347 | 9/1972 | Kydd et al. | 60/39.3 |
| 3,747,336 | 7/1973 | Dibelius et al. | 60/39.3 |
| 4,128,994 | 12/1978 | Cheng . | |
| 4,680,927 | 7/1987 | Cheng | 60/39.3 |
| 4,893,467 | 1/1990 | Woodson | 60/39.55 |
| 5,170,622 | 12/1992 | Cheng | 60/39.05 |
| 5,329,758 | 7/1994 | Urbach et al. . | |

FOREIGN PATENT DOCUMENTS

| | | |
|---|---|---|
| 1170842 | 7/1984 | Canada . |
| 1134503 | 4/1957 | France . |
| 3419960A1 | 11/1985 | Germany . |

*Primary Examiner*—Louis J. Casaregola
*Attorney, Agent, or Firm*—M. G. Panian

[57] ABSTRACT

A method of operating a gas turbine in which variations in power requirements are accomplished by varying the rate of steam injection into the combustor while maintaining the temperature of the fluid flowing to the turbine at a constant value. The steam injection flow rate is varied by varying the pressure in the evaporator of a HRSG that receives exhaust gas from the turbine. Preferably, the flow area of the turbine is increased so as to allow the use of especially high rates of steam injection.

10 Claims, 4 Drawing Sheets

METHOD FOR REGULATING AND AUGMENTING THE POWER OUTPUT OF A GAS TURBINE

BACKGROUND OF THE INVENTION

The present invention relates to a gas turbine power plant and a method of operating same. More specifically, the present invention relates to a method and apparatus for regulating and augmenting the power output of a gas turbine power plant by varying the flow rate of steam injected into the gas turbine combustor.

A gas turbine is comprised of a compressor section that produces compressed air that is subsequently heated by burning fuel in a combustion section. The hot gas from the combustion section is directed to a turbine section where the hot gas is used to drive a rotor shaft, thereby producing shaft power. The shaft power is used to drive the compressor. The excess power not consumed by the compressor drives a generator that produces electrical power. The amount of power imparted to the shaft is a function of the mass flow and temperature of the hot gas flowing through the turbine.

Owing to their rapid response, gas turbines are often used in environments in which the power demand varies. Traditionally, variations in power output have been accomplished by varying the rate at which fuel was burned in the combustor and, therefore, the temperature of the hot gas expanded in the turbine. However, such a method of regulating power output suffers from several drawbacks. First, the maximum temperature to which the hot gas may be heated is limited due to limitations on the strength of the components in the turbine at high temperature. Second, variations in gas temperature can induce transient thermal stresses in the turbine components due to differential thermal expansion. Therefore, frequent variations in hot gas temperature can have a deleterious effect on the thermal fatigue life of the turbine components.

The combustion process in a gas turbine typically results in the generation of oxides of nitrogen (NOx), which is considered an atmospheric pollutant. In the past steam or water has been injected into the combustor for the purpose of reducing the flame temperature and, hence, the rate of NOx formation. While it is known that injecting steam into the combustor increases the power output of the turbine, in the past, the amount of steam that could be safely injected without causing excessive back pressure in the compressor was limited by the flow capacity of the turbine, which was typically designed for dry operation. Hence, the ability to utilize steam injection for power augmentation was limited.

Therefore, it is desirable to provide a gas turbine into which large amounts of steam can be safely introduced in order to augment the power output of the turbine, and in which the power output may be regulated by varying the amount of steam introduced.

SUMMARY OF THE INVENTION

Accordingly, it is the general object of the current invention to provide a gas turbine into which large amounts of steam can be safely introduced in order to augment the power output of the turbine, and in which the power output may be regulated by varying the amount of steam introduced.

Briefly, this object, as well as other objects of the current invention, is accomplished in a method of regulating the operation of a gas turbine power plant so as to achieve a desired shaft power, comprising the steps of (i) compressing air, (ii) heating the compressed air, thereby producing a hot gas, (iii) directing a variable flow rate of steam into the hot gas, thereby producing a mixture of hot gas and steam, (iv) expanding the mixture of the hot gas and steam in a turbine, thereby producing an expanded gas, whereby the expansion of the mixture of the hot gas and steam imparts power to a turbine shaft, the power being a function of the flow rate of the hot gas and the flow rate of the steam, and (v) adjusting the flow rate of the steam to a desired steam flow rate so as to obtain the desired shaft power in the turbine shaft while maintaining approximately constant temperature of the mixture of hot gas and steam to be expanded in the turbine.

According to one embodiment of the method, the step of directing a variable flow rate of steam into the hot gas comprises generating the variable flow rate of steam by transforming feed water into the steam at a variable pressure. The flow rate of the steam being adjusted so as to obtain the desired steam flow rate by adjusting the pressure at which the steam is generated, thereby varying the saturation temperature of the feed water. Moreover, in this embodiment, the step of transforming the feed water into the steam at a variable pressure comprises directing the feed water and the expanded gas through a heat recovery steam generator.

The current invention also encompasses a gas turbine power plant apparatus comprising (i) a compressor for producing compressed air, the compressor having an exit annulus through which the compressed air exits the compressor, the exit annulus having an area, (ii) a combustor for heating the compressed air by burning a fuel therein, (iii) means for generating a flow of steam and for directing the flow of steam into the combustor, whereby the combustor produces a hot compressed gas/steam mixture, and (iv) a turbine for expanding the hot compressed gas/steam mixture so as to produce an expanded gas/steam mixture, the turbine having an inlet for receiving the hot compressed gas/steam mixture from the combustor, the turbine inlet having a flow area, the ratio of the turbine inlet flow area to the compressor exit annulus area having a value of at least approximately 1.05.

DESCRIPTION OF THE PREFERRED EMBODIMENT

Figure 1:
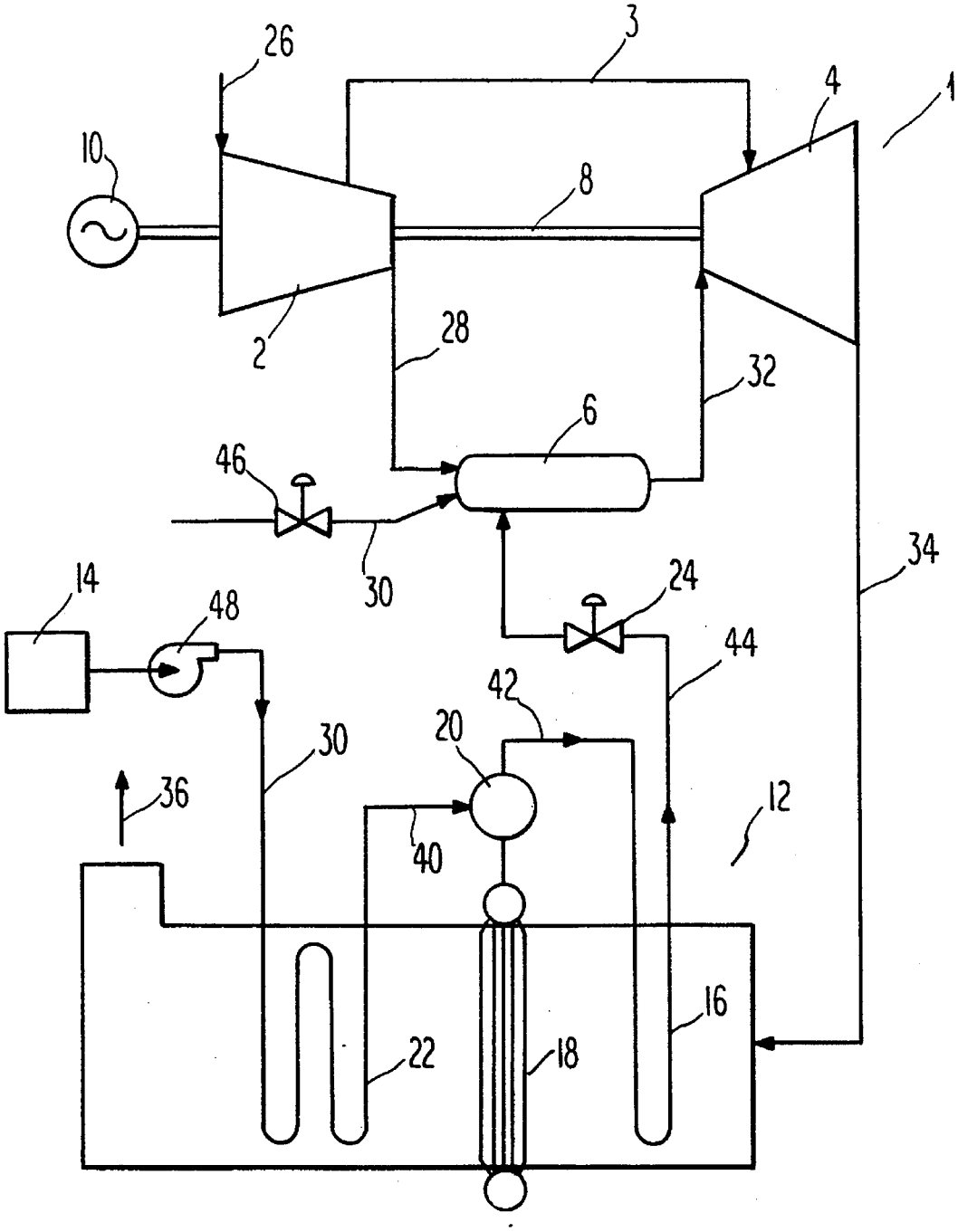
FIG. 1 is a schematic diagram of a gas turbine power plant having the capability of regulating and augmenting power output by varying the rate of injection of steam into the combustor according to the current invention.

Referring to the drawings, there is shown in FIG. 1 a schematic diagram of a gas turbine power plant. The major components of the power plant include a gas turbine 1 and a heat recovery steam generator 12. The gas turbine 1 includes a compressor 2, a turbine 4 having a rotor shaft 8 connected to the compressor and to an electrical generator 10, and a combustor 6. The HRSG 12 includes a superheater 16, an evaporator 18, a steam drum 20, an economizer 22, and a pressure control valve 24.

In operation, the compressor 2 inducts ambient air 26 and compresses it, thereby producing compressed air 28. The pressure of the compressed air will depend on the firing temperature of the gas turbine but will typically be in the range of 700 to 2100 kPa (100 to 300 psi). A portion 3 of the air inducted by the compressor 2 is drawn from an interstage compressor bleed and directed to the turbine 4 for cooling therein. The remainder of the compressed air 28 is directed to the combustor 6, along with a fuel 30.

The fuel 30, typically natural gas or distillate oil, is introduced into the compressed air 28 via a nozzle (not shown). The flow rate of the fuel 30 is regulated by a flow control valve 46. The fuel 30 burns in the compressed air, thereby producing a hot gas. According to the current invention, a flow of superheated steam 44 from the HRSG 12 is introduced into the hot gas, thereby producing a mixture 32 of hot gas and steam. The steam 44 may be introduced into the combustor 6 by means of passages in the nozzle through which the fuel is introduced, as is conventional, or by means of some other port in the combustor 6 or associated ductwork. Alternatively, some or all of the steam 44 could be introduced into the compressed air 28 prior to entering the combustor 6.

The mixture 32 of hot gas and steam is then directed to the turbine 4. Preferably, according to the current invention, the flow rate of the fuel 30 burned in the combustor 6 is regulated by the flow control valve 46 so that the temperature of the hot gas/steam mixture 32 is maintained at a constant value regardless of the power output required from the turbine 4, so long as the required power does not drop below a certain minimum value (i.e., the power output at zero steam injection). This constant temperature is based on the optimum continuous operating temperature for the turbine 4 and, in a modern gas turbine, may be as high as 1260° C. (2300° F.), or higher.

In the turbine 4, the hot gas/steam mixture 32 is expanded, thereby producing power in the rotor shaft 8 that drives both the compressor portion of the rotor and the electrical generator 10. This power is a function of the temperature, pressure and mass flow rate of the hot gas/steam mixture 32. The expanded gas/steam mixture 34 is then exhausted from the turbine 4. As a result of having been expanded in the turbine 4, the temperature of the expanded gas/steam mixture 34 has dropped. In a modern gas turbine operating with a hot gas/steam mixture 32 in the optimum temperature range for the turbine 4, the temperature of the expanded gas/steam mixture 34 is typically in the range of 450°–600° C. (850°–1100° F.).

The expanded gas/steam mixture 34 is then directed to the HRSG 12. In the HRSG 12, the expanded gas/steam mixture 34 is directed by ductwork so that it flows successively over the superheater 16, the evaporator 18 and the economizer 22. The gas/steam mixture 36 is then discharged to atmosphere. As is conventional, the superheater 16, the evaporator 18 and the economizer 22 may have heat transfer surfaces comprised of finned tubes. The expanded gas/steam mixture 34 flows over these finned tubes and the feedwater/steam flows within the tubes. In the HRSG 12, the expanded gas/steam mixture 34 transfers a considerable portion of its heat to the feedwater/steam. As a result, the temperature of the gas/steam mixture 36 discharged from the HRSG 12 is considerably lower than that of the expanded gas/steam mixture 34 entering the HRSG and may be as low as 150° C. (300° F.), or lower.

Feedwater 38 from a feedwater supply 14 is pressurized and directed to the economizer 22 via a pump 48. The economizer 22 has sufficient heat transfer surface area to heat the feedwater 38 to a temperature close to, but preferably below, the saturation temperature of the feedwater at the minimum pressure to be maintained in the evaporator 18. The heated feedwater 40 is then directed to a steam drum 20 connected to the evaporator 18.

As is conventional, the heated feedwater 40 in the drum 20 is circulated through the heat transfer tubes of the evaporator 18. Such circulation may be by natural means or by forced circulation. The evaporator 18 converts the feedwater 40 into saturated steam 42. The rate at which the feedwater 40 is converted to steam 42—that is, the steam generation rate—is a function of the heat transfer surface area and the operating pressure of the evaporator, as well as the temperature and flow rate of the expanded gas/steam mixture 34, as discussed below. A conventional feedwater control system, which may include a feedwater control valve, water level sensors, etc., may be utilized to maintain the level of feedwater 40 in the drum 20 within an appropriate range in order to prevent the flooding of the drum or the drying out of the evaporator 18 as the steam generation rate varies.

Only the heat in the expanded gas/steam mixture 34 flowing over the evaporator 18 that is above the saturation temperature of the feedwater 40 circulating through the evaporator is capable of converting the feedwater to steam 42. Thus, for example, if the temperature Tex of the expanded gas/steam mixture 34 flowing over the evaporator 18 were equal to, or less than, the saturation temperature Tsat of the feedwater 40 in the evaporator, the rate of steam generation Gst in the evaporator would be zero. Consequently, the lower the saturation temperature of the water in the evaporator 18, the higher the steam generation rate.

Figure 2:
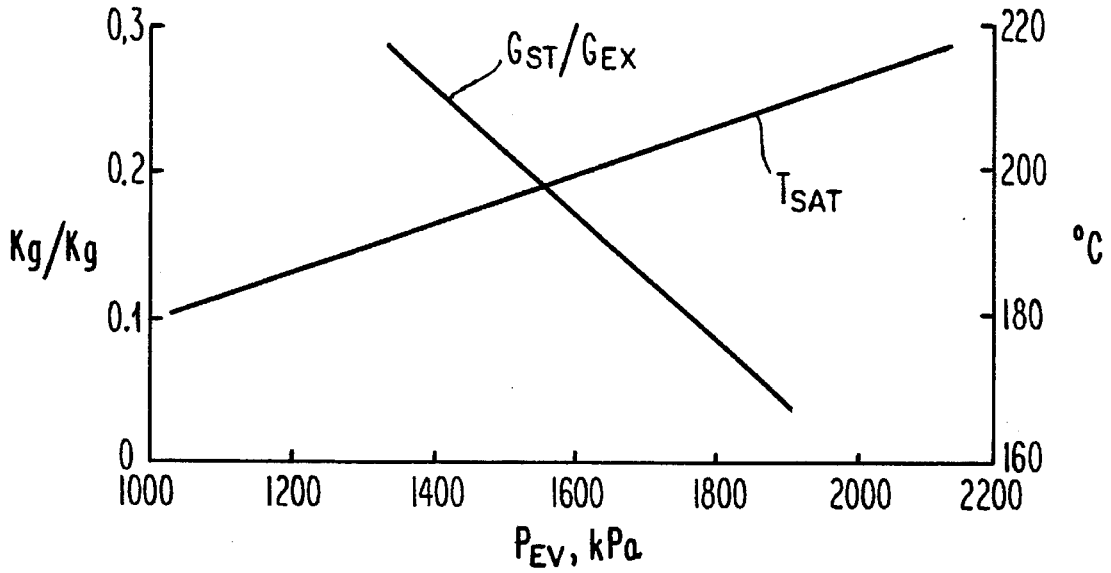
FIG. 2 is a graph of (i) a curve showing the relationship of saturation temperature, Tsat, versus pressure for water and (ii) a curve showing the effect that varying the pressure Pev maintained in the evaporator of FIG. 1 (and, therefore, the saturation temperature of the water therein) has on the ratio, Gst/Gex, of the flow rate of saturated steam produced by the evaporator to the flow rate of exhaust gas directed to the evaporator for a typical gas turbine having an exhaust temperature of 575° C. (1070° F.).

FIG. 2 shows the manner in which the saturation temperature of water Tsat varies with its pressure Pev over a typical range of interest. As can be seen, decreasing the pressure Pev from 2000 kPa (300 psig) to 1000 kPa (150 psig) results in a decrease in the saturation temperature from 214° C. (417° F.) to 181° C. (358° F.). Consequently, the lower the evaporator pressure, the higher the steam generation rate.

FIG. 2 also shows the manner in which the mass flow rate Gst of saturated steam 42 generated by the evaporator 18, normalized based on a unit mass flow rate Gex of the expanded gas/steam mixture 34, varies with the pressure maintained in the evaporator 18 for a typical expanded gas/steam mixture 34 having a temperature of about 540° C. (1000° F.). As can be seen, decreasing the evaporator 18 pressure Pev from 1800 kPa to 1400 kPa more than triples the steam generation rate, increasing it from about 0.08 kg/kg—that is, 0.08 kilograms of steam for each kilogram of expanded gas 34 flowing through the HRSG 12—to about 0.26 kg/kg. Thus, the steam generation rate of the evaporator 18 is a strong function of the pressure maintained in the evaporator, as well as the temperature and mass flow rate of the expanded gas/steam mixture 34 flowing through the HRSG 12.

From the evaporator 18, the saturated steam 42 is directed to a superheater 16 in which its temperature is raised into the superheat region. Although a certain amount of superheating is desirable to reduce the additional fuel 30 that must be burned in the combustor 6 in order to heat the hot gas/steam mixture 32 directed to the turbine to the desired temperature, the amount of superheat is not critical to achieve the benefits of the current invention. Moreover, since the expanded gas/steam mixture 34 gives up a portion of its heat in the superheater 16 before it reaches the evaporator 18, the greater the amount of superheating, the lower the steam generation rate.

Figure 3:
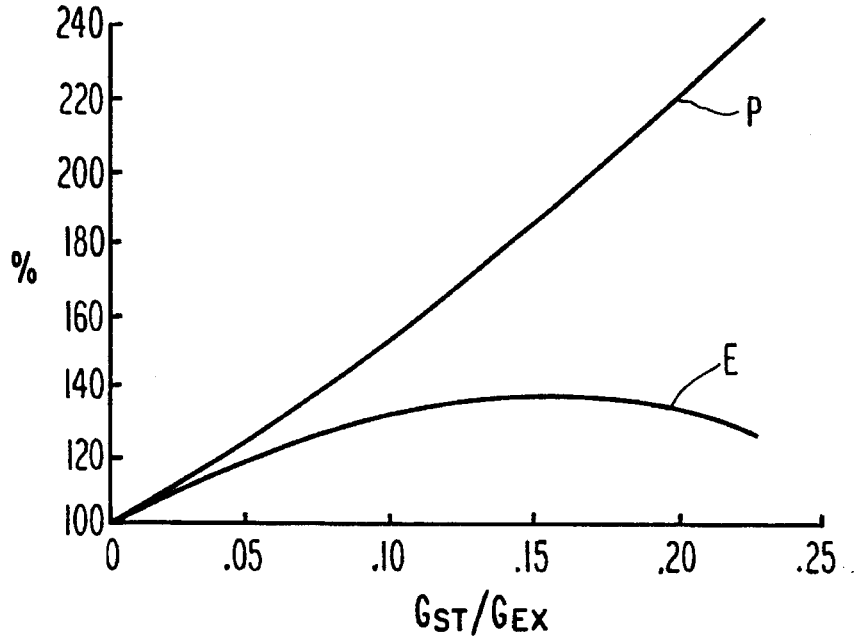
FIG. 3 is a graph showing the effect that increasing the steam injected into the combustor, expressed as the ratio Gst/Gex, has on the power output P and efficiency E of a typical gas turbine of the type shown in FIG. 1, expressed in percent (100% being the power and efficiency without any steam injection).

As previously discussed, the power developed in the turbine 4 is a function of the temperature and mass flow rate of the hot gas/steam mixture 32 flowing through it. Thus, adding the steam 44 into the combustor 6—or into the compressed air 28—has the effect of increasing the mass flow rate of the hot gas/steam mixture 32 and, therefore, the turbine power output. FIG. 3 shows the percent increase in the net power output P at the generator 10 as the steam injection rate increases. As can be seen, at a steam injection rate equal to 15% of the flow rate of the expanded gas/steam mixture 34 (i.e., Gst/Gex=0.15), and with the temperature of the fluid entering the turbine 4 being maintained at a constant value, the net power output is increased by approximately 90% and the thermal efficiency by approximately 40% over that with no steam injection.

Unfortunately, despite a certain amount of superheating in the superheater 16, the temperature of the steam 44 is less than the optimum temperature of the fluid to be expanded in the turbine 4 that will result in optimum performance (i.e., the base load turbine inlet design temperature). Moreover, the greater the steam generation rate, the less the amount of superheat that can be achieved. Therefore, additional fuel must be burned in the combustor 6 to maintain the temperature of the hot gas/steam mixture 32 at the optimum constant value as the steam injection rate increases and the steam temperature decreases. As a result of this increased fuel flow, the thermal efficiency of the gas turbine 1 begins decreasing beyond a certain steam flow rate, as shown in FIG. 3.

According to the current invention, variations in the power output requirements of the gas turbine 1 can be accommodated by varying the flow rate of injected steam—and, therefore, the flow rate of the gas/steam mixture entering the turbine 4—rather than by varying the temperature of the hot gas entering the turbine. Moreover, the variation in steam injection can be accomplished by varying the pressure in the evaporator 18, and therefore the steam generation rate, as previously discussed. This variation in pressure can readily be accomplished by operation of the pressure control valve 24, installed in the piping that directs the superheated steam 44 from the superheater 16 to the combustor 6. For example, an increase in power output of approximately 35% can be accomplished by merely opening the pressure control valve 24 sufficiently far to drop the pressure in the evaporator 18 from 1800 kPa to 1600 kPa, thereby increasing the steam generation rate ratio Gst/Gex from 0.085 to 0.175, as shown in FIG. 2, and, therefore, increasing the power output from 150% to 205% of the dry combustion power, as shown in FIG. 3.

As can readily be seen, the method of operation according to the current invention allows augmentation of the gas turbine power output to meet demands in excess of those that would otherwise be possible from dry operation of the turbine without exceeding safe operating temperatures levels for the turbine 4. In addition, this method also permits load fluctuations to be accommodated without any change in the temperature of the fluid supplied to the turbine, thereby minimizing the cyclical thermal stress to which the turbine components are subjected.

Figure 4:
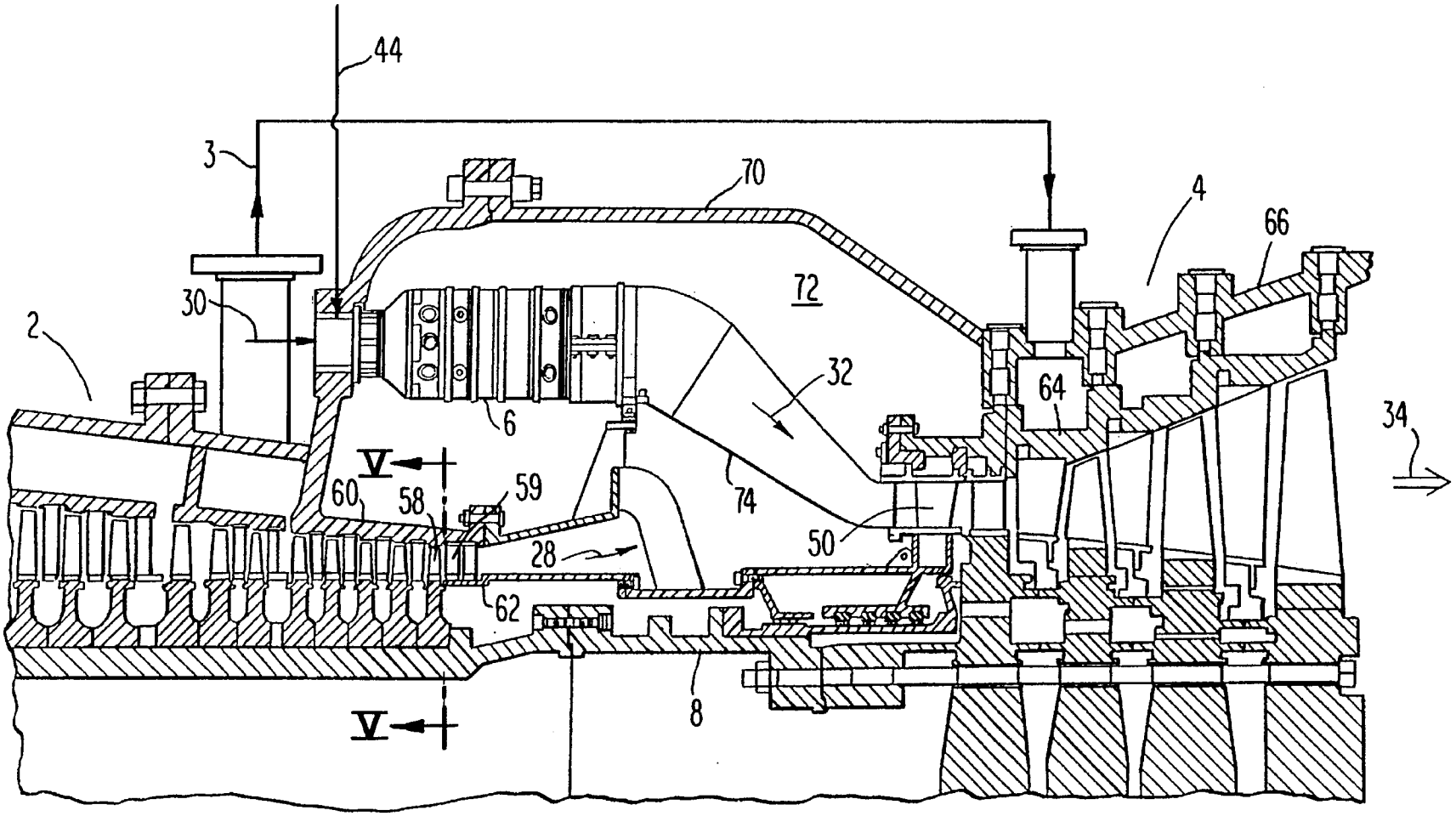
FIG. 4 is a is a portion of longitudinal cross-section through the gas turbine shown in FIG. 1.
Figure 5:
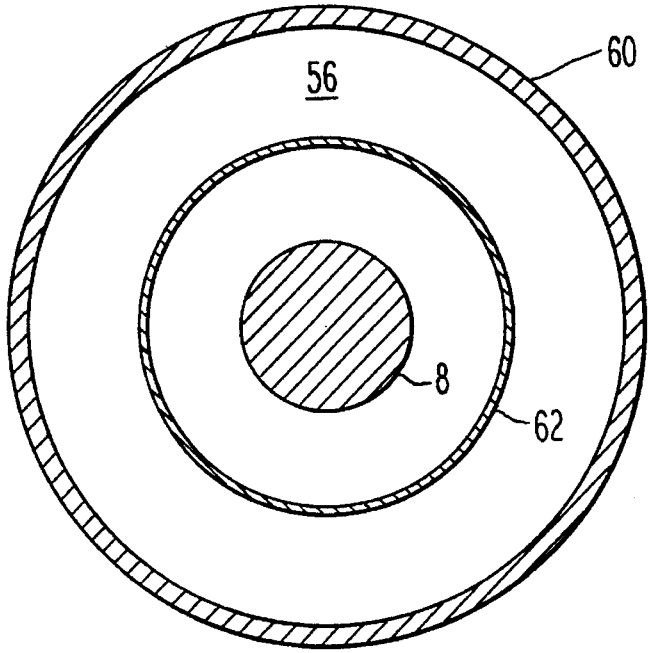
FIG. 5 is transverse cross-section taken through line V—V shown in FIG. 4.

A modification of the turbine apparatus itself to facilitate the use of steam injection to augment power output, as discussed above, will now be disclosed. FIG. 4 is a cross-sectional view of a portion of the gas turbine 1. As can be seen, the gas turbine compressor 2 is comprised of a plurality of rows of stationary vanes affixed to a compressor cylinder 60 and a plurality of rows of rotating blades affixed to discs mounted on the compressor portion of the rotor 8. Outlet guide vanes 59 are disposed immediately downstream of the last row of rotating compressor blades 58. As shown in FIG. 5, the exit annulus 56 of the compressor 2 is formed by the cross-sectional area between the compressor cylinder 60 and an inner shroud 62 of the exit guide vanes 59 at a location immediately downstream of the last row of blades 58.

The compressed air 28 discharged from the compressor 2 is directed to a chamber 72 formed by a combustion section cylinder 70. From the chamber 72, the compressed air 28 enters the combustors 6 (only one of which is shown in FIG. 4) and is heated by the combustion of fuel 30, as previously discussed. Also as previously discussed, according to the current invention, superheated steam 44 is also introduced into the combustors 6.

From the combustors 6, the hot steam/gas mixture 32 is directed by ducts 74 to the turbine section 4. The turbine 4 is comprised of an outer cylinder 66 that encloses an inner cylinder 64. Within the inner cylinder 64, the hot steam/gas 32 flows over alternating rows of stationary vanes and rotating blades. The rows of stationary vanes are affixed to the inner cylinder 64. The rows of rotating blades are affixed to discs that form the turbine portion of the rotor 8.

Figure 6:
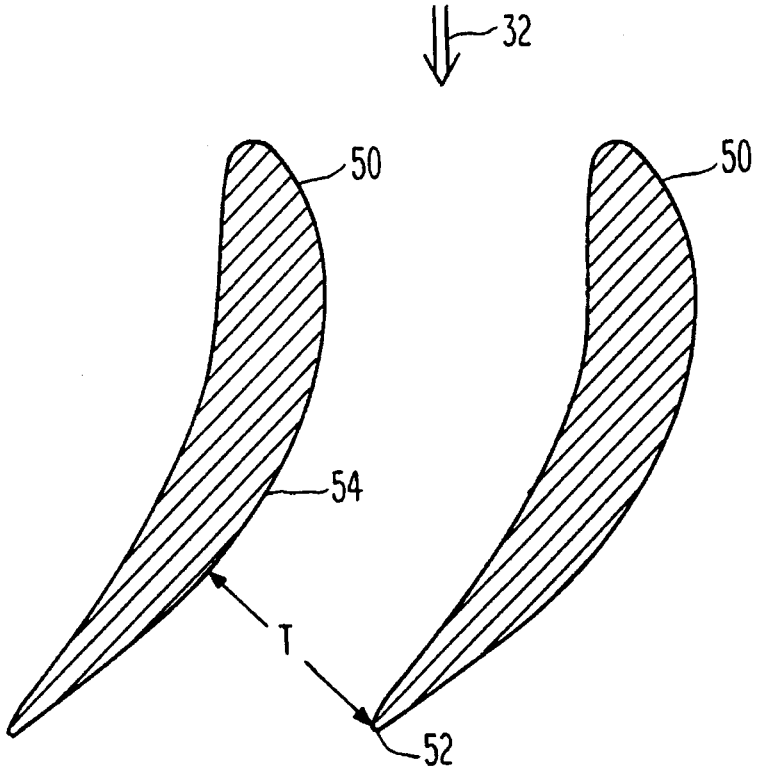
FIG. 6 is a cross-section through two adjacent turbine vanes in the first row of the turbine shown in FIG. 4.

FIG. 6 shows two adjacent first stage vanes 50 of the turbine 4. The shortest distance from the trailing edge portion 52 of one vane 50 to the suction surface 54 of the adjacent vane is indicated by T and constitutes the exit opening, or throat, of the stage. The flow area of the stage is equal to the throat T times the height of the vanes 50. This flow area determines the inlet flow capacity of the turbine 4. Since the cooling air 3 bleed from the compressor 2 is eventually returned to the working fluid downstream of the first stage vanes 50, downstream stages of the turbine have flow areas that are sized to handle the increase in flow associated with the return of cooling air to the working fluid.

In a typical modern gas turbine, a portion of the compressed air flowing through the compressor is bled off for cooling purposes—typically, approximately 5–12% of the compressor inlet air flow. The cross-sectional area of the compressor discharge annulus 56 is sized to accommodate the flow rate of the compressed air 28 discharging from the compressor, which, for the reasons discussed above, is less than the flow rate of the compressor inlet air 26. The rate of flow of the fuel 30 is typically equal to about 2 to 3% of the flow rate of the compressor inlet air. Consequently, in a conventional gas turbine, the flow rate of the hot gas entering the turbine 4 is approximately 102 to 103% of the flow rate of the compressor air 28 discharging from the compressor and the flow area of the first stage turbine vanes is set accordingly—a process sometimes referred to as matching.

Since the area of the compressor exit annulus 56 is a function of the flow rate of the air 28 discharging from the compressor 2 and the flow area of the first stage turbine vanes is a function of the turbine inlet flow capacity, the ratio of these two areas is indicative of the "matching" between the turbine and the compressor. In conventional gas turbines, designed to operate with no steam injection or with only the relatively small amount of steam injection required for NOx control, the ratio of throat area of the first stage turbine vanes to the area of the compressor exit annulus is in the range of approximately 0.75 to 0.85. Consequently, the amount of steam 44 that can be introduced into the combustors 6 is limited since too great an increase in the flow rate of the hot gas/steam mixture 32 entering the turbine 4 will result in excessive back pressure on the compressor 2. Such excessive back pressure can lead to flow instabilities, such as compressor surge.

Therefore, according to the current invention, the flow capacity of the turbine 4 is increased to permit the use of higher flow rates of steam 44 than has heretofore been possible in order to maximize the ability of the operator to augment the power output of the turbine by the use of steam injection. In the preferred embodiment of the invention, the flow area of the first stage turbine vanes 50 has been increased so that the ratio of the throat area of the first stage turbine vanes 50 to the cross-sectional area of the compressor exit annulus 56 is at least approximately 1.05. The pressure at the inlet to the turbine 4 is a function of the flow rate of the gas/steam mixture flowing through the turbine and, therefore, is also a function of the flow rate of steam 44. Consequently, such matching will result in a decrease in the efficiency of the gas turbine when it is operated without the introduction of steam 44 into the combustors 6 since the gas turbine will be operating considerably below its ideal pressure ratio. However, such matching will allow the use a steam 44 flow rate as high as approximately 25% of the flow rate of the gas/steam mixture 34 discharged from the turbine 4, which is essentially the maximum amount of steam that can be produced by recovering heat from the exhaust gas 34 of a modern gas turbine.

According to the preferred embodiment of the current invention, the heat transfer area in the HRSG 12 is such that the flow rate of the steam 44 introduced into the combustors 6 is at least 15% of the flow rate of the gas/steam mixture 34 discharging from the turbine 4. If desired, the steam pressure in the evaporator 18 can be adjusted, as previously discussed, to obtain a steam flow rate that will result in the optimum turbine pressure ratio and, therefore, the optimum performance.

Although the present invention has been illustrated by reference to steam generation by a HRSG, the invention is also applicable to other methods of steam generation. Therefore, the present invention may be embodied in other specific forms without departing from the spirit or essential attributes thereof and, accordingly, reference should be made to the appended claims, rather than to the foregoing specification, as indicating the scope of the invention.

We claim:

1. A method of regulating the operation of a gas turbine power plant so as to achieve a desired shaft power, comprising the steps of:

a) compressing air;

b) heating said compressed air, thereby producing a hot gas;

c) directing a variable flow rate of steam into said hot gas, thereby producing a mixture of hot gas and steam;

d) expanding said mixture of hot gas and steam in a turbine, thereby producing an expanded gas/steam mixture, said turbine having a rotating shaft disposed therein, whereby said expansion of said mixture of hot gas and steam imparts power to said shaft, said power being a function of the flow rate of said hot gas/steam mixture; and e) adjusting said flow rate of said gas/steam mixture by adjusting said flow rate of said steam, so as to maintain said desired shaft power from said turbine shaft while maintaining approximately constant the temperature of said gas/steam mixture that is expanded in said turbine.

2. The method of operation according to claim 1, wherein the step of directing said variable flow rate of steam into said hot gas comprises generating said variable flow rate of steam by transforming feed water into said steam at a variable pressure, said flow rate of said steam being varied by adjusting said pressure at which said steam is generated, thereby varying the saturation temperature of said feed water.

3. The method of operation according to claim 2, wherein the step of transforming said feed water into said steam at a variable pressure comprises directing said feed water and said expanded gas/steam mixture through a heat recovery steam generator.

4. The method of operation according to claim 2, wherein the step of transforming said feed water into said steam at a variable pressure comprises:

a) flowing said feed water through an economizer over which said expanded gas/steam mixture flows, thereby pre-heating said feed water; and b) flowing said pre-heated feed water through an evaporator over which said expanded gas/steam mixture flows, thereby transforming said feed water into said steam and discharging said steam from said evaporator.

5. The method of operation according to claim 4, wherein the step of adjusting said pressure at which said steam is generated comprises adjusting the opening of a valve controlling the discharge of said steam from said evaporator.

6. The method of operation according to claim 2, wherein the step of generating said steam comprises transferring heat from said expanded gas/steam mixture produced by said turbine to said feed water, said expanded gas/steam mixture having a temperature, whereby said flow rate of said steam generated is a function of the difference between said expanded gas/steam temperature and said feed water saturation temperature.

7. The method of operation according to claim 6, wherein the step of heating said compressed air so as to produce said hot gas comprises adjusting the temperature of said hot gas so as to maintain the temperature of said gas/steam mixture at a predetermined value despite variations in said flow rate of said steam.

8. The method of operation according to claim 7, wherein the step of heating said compressed gas comprises burning a fuel in said compressed air, said temperature of said hot gas being adjusted by adjusting the rate at which said fuel is burned.

9. The method of operation according to claim 1, wherein said flow rate of said steam varies within a range of from zero to at least 20% of the flow rate of said expanded gas/steam mixture.

10. A method of regulating shaft power in a gas turbine power plant, comprising the steps of:

a) compressing air in a compressor;

b) heating said compressed air in a combustor by burning a fuel therein, thereby producing a flow of hot gas;

c) directing a flow of feed water into an evaporator, thereby generating a flow of steam at a steam generation rate;

d) variably adjusting a valve disposed in a conduit directing said generated steam from said evaporator, thereby regulating said steam generation rate by varying the pressure of said feed water in said evaporator;

e) introducing said generated steam into said flow of hot gas, thereby producing a mixture of hot gas and generated steam flowing at a flow rate, said flow rate of said mixture being proportional to said steam generation rate;

f) regulating the amount of said fuel burned so as to maintain the temperature of said mixture of hot gas and generated steam at a predetermined value despite variations in said rate of steam generation;

g) directing said mixture of hot gas and generated steam to a turbine having a rotating shaft for expansion therein, thereby producing power in said shaft proportional to said flow rate of said mixture of hot gas and generated steam, whereby said shaft power is regulated by varying said pressure of said feed water in said evaporator; and h) exhausting said mixture of hot gas and generated steam from said turbine after said expansion and directing said exhausted mixture to flow over said evaporator, thereby transferring heat from said exhausted mixture to said feed water flowing in said evaporator, whereby said heat transfer generates said steam.

* * * * *